US008727150B2

(12) United States Patent
Lemke et al.

(10) Patent No.: US 8,727,150 B2
(45) Date of Patent: May 20, 2014

(54) DEVICE FOR ATTACHING A FIGURINE ONTO A BEVERAGE BOTTLE, COMBINATION OF A FIGURINE AND A DEVICE, AND A COMBINATION OF A FIGURINE AND DEVICE ATTACHED TO A BEVERAGE BOTTLE

(75) Inventors: Stefan Lemke, Dassow (DE); Bernhard Wettlaufer, Garmisch-Partenkirchen (DE); Götz Thomas, Itzehoe (DE)

(73) Assignee: PCO Group GmbH, Garmisch-Partenkirchen (DE)

( * ) Notice: Subject to any disclaimer, the term of this patent is extended or adjusted under 35 U.S.C. 154(b) by 18 days.

(21) Appl. No.: 12/740,222

(22) PCT Filed: Oct. 29, 2009

(86) PCT No.: PCT/EP2009/007744

§ 371 (c)(1),
(2), (4) Date: Apr. 28, 2010

(87) PCT Pub. No.: WO2010/049151

PCT Pub. Date: May 6, 2010

(65) Prior Publication Data

US 2011/0303631 A1 Dec. 15, 2011

(30) Foreign Application Priority Data

Oct. 30, 2008 (DE) ..... 10 2008 053 927

(51) Int. Cl.
*B65D 41/00* (2006.01)

(52) U.S. Cl.
USPC ..... 215/228; 215/388; 446/391; 220/212; 220/288; 220/259.3; 220/780

(58) Field of Classification Search
USPC ..... 215/228, 388, 329, 287; 220/212, 288, 220/256.1, 259.1, 254.4, 245.5, 259.3, 319, 220/780, 784, 376, 709; 446/901, 475, 268, 446/391, 491; 40/311
See application file for complete search history.

(56) References Cited

U.S. PATENT DOCUMENTS 2,546,122 A 3/1951 Goldfarb
4,938,395 A * 7/1990 Jamieson ..... 222/478

(Continued)

FOREIGN PATENT DOCUMENTS

EP 2 105 388 9/2009
FR 386 710 4/2008

(Continued)

OTHER PUBLICATIONS

International Search Report and Written Opinion excerpt issued in related International application No. PCT/EP2009/007744 mailed Jul. 8, 2010.

*Primary Examiner* — J. Gregory Pickett
*Assistant Examiner* — Raven Collins
(74) *Attorney, Agent, or Firm* — Lempia Sumerfield Katz LLC

(57) ABSTRACT

A device attaches a figurine with a cylindrical base part onto a beverage bottle. A combination of such a device and a figurine as well as a beverage bottle made of plastic forms a sales unit with such a device and such a figurine. In order to enable the figurine to be joined separably to the beverage bottle to form a sales unit in a simple, aesthetical and sales-promoting manner, the device includes a body having means for separable attachment of the figurine and having a recess for holding a screw cap and a neck part provided with an outside thread of the beverage bottle.

11 Claims, 10 Drawing Sheets

(56) References Cited

U.S. PATENT DOCUMENTS

| | | | | |
|---|---|---|---|---|
| 5,502,981 | A | 4/1996 | Sullivan | |
| 5,509,551 | A | 4/1996 | Terrell, II | |
| 5,518,143 | A * | 5/1996 | Iodice | 220/708 |
| 5,711,446 | A * | 1/1998 | Jeffs et al. | 220/23.83 |
| 6,758,358 | B1 * | 7/2004 | Bloom | 215/206 |
| 6,877,626 | B2 * | 4/2005 | Sherrod | 215/319 |
| 7,025,653 | B1 * | 4/2006 | Hawkins | 446/74 |
| 2009/0145874 | A1 * | 6/2009 | Hite | 215/227 |
| 2009/0184083 | A1 * | 7/2009 | Cho | 215/227 |

FOREIGN PATENT DOCUMENTS

| | | |
|---|---|---|
| WO | WO 01/89952 | 11/2001 |
| WO | WO 2005/060359 | 7/2005 |

* cited by examiner

DEVICE FOR ATTACHING A FIGURINE ONTO A BEVERAGE BOTTLE, COMBINATION OF A FIGURINE AND A DEVICE, AND A COMBINATION OF A FIGURINE AND DEVICE ATTACHED TO A BEVERAGE BOTTLE

RELATED APPLICATION DATA

This U.S. national phase application is based on international application no. PCT/EP2009/007744, filed on Oct. 29, 2009, which claimed priority to German national patent application 10 2008 053 927.9 filed on Oct. 30, 2008. Priority benefit of these earlier filed applications is hereby claimed, and the full disclosures of these earlier filed applications are hereby incorporated by reference herein.

BACKGROUND

1. Field of the Disclosure

The invention concerns a device for attaching a figurine onto a beverage bottle, a combination of such an attaching device and a figurine, as well as a beverage bottle with such a combination.

2. Description of the Related Art

Figurines, also called "toppers" in English, are characters known from movies or television which are reproduced in a reduced form three-dimensionally in plastic, and are sold to promote the purchase of beverages, popcorn, cotton candy or similar in movie theatres and similar as one purchased unit together with the latter products. Hereby, the said products are offered in cups, the covers of which have a figurine. In order to attach the figurines, the cover that serves for closing the cup, optionally provided with an opening for a straw and manufactured by injection molding or deep drawing from plastics, during manufacture is provided with a cylindrical recess open toward the top into which a cylindrical base of the figurine can be inserted with a press fit. After consumption of the product, the figurine can be removed from the cover of the cup and used as a toy or collectible, whereby the solid base serves to improve the stability of the figurine placed on a support.

A cover for a beverage cup which has a recess in the middle for the base of such a figurine is disclosed, for example, in EP 2 105 388 A1.

However, particularly in connection with the sale of soft drinks, it is regarded as a disadvantage that the soft drink can only be offered in combination with such a figurine if it has first been poured into a cup whose cover is suitable for attaching a figurine. Besides the additional material used, the additional labor and the additional waste related to the pouring of the soft drink into the cup, soft drinks sold in a cup also lead more easily to a spilling of the remaining soft drink as a result of a tipping over of the mostly empty cup. Moreover, many clients prefer the consumption of soft drinks directly from a beverage bottle because the non-contamination of the contents before opening for the first time is ensured and after partial consumption there is again the possibility of resealing. The commercial figurines with cylindrical bases that are suitable for attachment to the cup covers however cannot be attached to the commonly used beverage bottles in such a way that on the one hand an aesthetic appearance of the product results and on the other hand it makes it clearly visible for the customer that the beverage bottle and the figurine form a joint sales unit.

SUMMARY

Based on this, the task of the invention is to create a device of the type named at the outset with which the known figurines can be joined with an aesthetic appearance and promoting sales in a simple manner and separably with almost all the usual beverage bottles that are made of plastic to form a single sales unit.

According to the invention, this task is solved by the fact that the device comprises a body that has means for separable attachment of the figurine as well as a recess for attaching to a screw cap and/or to a neck part of the beverage bottle provided with an outside thread.

In a first variation of the device according to the invention, the body has two preferably cylindrical recesses pointing to opposite sides, one of which preferably can hold a preferably cylindrical base of the figurine and the other can hold the screw cap of the beverage bottle.

The invention is based on recognizing the fact that almost all the usual beverage bottles that are filled with soft drinks are made of plastic and have only a few types of standardized screw threads, namely an outside thread of about 27 mm diameter, of which the most commonly used are the narrow-neck beverage bottles such as commercial PET bottles for mineral- and drinking water as well as for carbonated soft drinks, as well as an outside thread of about 31 mm or about 36 mm diameter for two less widely-used wide-neck beverage bottles.

This has as its consequence that the screw caps, also mostly made of plastic, that serve for closing the beverage bottles of each of these types, have not only identical inner cross-sectional dimensions, but, because of the attempt to minimize material consumption, also have almost identical outer cross-sectional dimensions. This means again that for almost any type of beverage bottle with a standardized screw thread, be it a disposable or returnable bottle independently of content, volume, material, manufacturer or filling operation of the bottle, only a single type of attaching device according to the invention will be needed, in which the inside diameter of the cylindrical recess serving for holding the screw cap of the beverage bottle is chosen such that it exceeds the core or pitch diameter of the screw thread formed on the neck of the beverage bottle by a defined amount.

A preferred embodiment of the invention provides that the inside diameter of the cylindrical recess for holding the screw cap of the beverage bottle exceed the core or pitch diameter of a screw thread formed on the neck part of the bottle by 5 mm±0.5 mm or by 3 mm±0.5 mm. An attaching device according to the invention provided with such dimensions can be attached to most plastic screw caps of narrow- or wide-neck beverage bottles with a sliding fit or with a slight press fit so that they can easily be removed or pulled off of the screw cap by the customer in order to open the beverage bottle.

While the inside diameter of the recess serving to hold the screw cap is usually about 30 mm for the attaching devices intended for narrow-neck beverage bottles, the attaching devices intended for wide-neck beverage bottles have an inside diameter either of about 36 mm or about 40 mm since two different thread diameters are used by the various manufacturers for wide-neck beverage bottles.

In order to ensure an attractive aesthetic appearance of the sales unit consisting of the beverage bottle, figurine and attaching device, the two recesses are arranged coaxially to one another. In addition, the body of the attaching device preferably has one or two cylindrical outer peripheral surfaces, which are preferably coaxial to the recesses and optionally can be provided entirely or partially with a knurling or with another surface property that facilitates the removal of the attaching device from the screw cap of the beverage bottle.

In order to keep the height of the body of the attaching device as low as possible in order to save material, to further improve the aesthetic appearance and to minimize the total height of the sales unit consisting of beverage bottle, figurine and attaching device, the body of the attaching device is preferably designed in a ring shape, whereby it surrounds an axial through-opening formed by the communicating recesses.

Between the recess serving to hold the base of the figurine and the recess serving to hold the screw cap, the through-opening preferably has an annular shoulder in order to take into account the different inner diameters of the two recesses. In order to reduce the height of the body of the attaching device, the annular shoulder expediently has a plane annular surface which is arranged perpendicularly to a longitudinal axis of the two recesses.

Since at least most narrow-neck beverage bottles, below the neck part that has the screw thread, are provided with an annular, radially projecting collar, that usually has an axial distance of about 20 mm from the opening of the neck part, another preferred embodiment of the invention provides that the axial length of the recess serving to hold the screw cap is expediently 22 mm or more so that the joint can serve as a stop for the neighboring front end of the body of the attaching device, without the upper end of the screw cap projecting beyond the annular shoulder into the recess serving to hold the base of the figurine.

The axial length of the recess serving to hold the base of the figurine is expediently smaller and preferably measures about 9 to 10 mm so that the base can be introduced into the recess until its bottom side away from the figurine touches and/or until a platform that radially projects on its top side touches the upper front end of the body of the attaching device.

In order to save material further, the body has a stepwise reduced outer periphery in the axial direction of the cylindrical recesses. The wall thickness of the recess that serves to hold the base of the figurine is expediently somewhat larger than the wall thickness of the recess serving to hold the screw cap, but it is also possible for these wall thicknesses to be substantially of equal size.

On its periphery, each of the two recesses may be delineated by a smooth cylindrical peripheral surface, but it can also be advantageous, at least in the case of the recess that serves to hold the screw cap, to provide it on its outer periphery with a knurling which would then mesh during the application of the attaching device onto the screw cap of a beverage bottle with a knurling that is usually applied on the outer periphery of the screw cap.

In combination with a press fit of the screw cap of the beverage bottle in such a recess, this meshing would make it possible to unscrew the screw cap by turning the attaching device, optionally after removal of the figurine, around the longitudinal axis of the beverage bottle. Due to the larger outside diameter of the body of the attaching device in comparison to the outside diameter of the screw cap, the opening of the beverage bottle would be facilitated, especially for older or weaker persons.

In a second variation of the device according to the invention, the body is designed so that it can be attached to the screw cap of the beverage bottle not only before sale, but after the sale of the beverage bottle and the removal of the screw cap, the body can also be attached to the outer thread of the neck part of the beverage bottle, for example in order to close this with the device already containing the figurine.

For this purpose, the body preferably has an open lower end, a lower section bordering the open end with a larger opening cross-section, as well as an upper section with a smaller opening cross-section, whereby the lower section takes up the screw cap with sliding fit or slight press fit and a peripheral wall of the upper section is provided with an inner thread for engagement with the outer thread of the neck part of the beverage bottle.

In the context of the above description, the terms "below", "above", "lower" and "upper" refer to the orientation of the body of the device in which this is attached to an upright standing beverage bottle.

In order to make it possible to drink from the beverage bottle in spite of the attachment of the device on the outer thread of the neck part, the recess of the body is preferably open toward the top so that a drinking straw can be introduced from the top into the recess, and through this into the neck part.

Hereby the drinking straw can be introduced through an opening in a base of the figurine into the recess. In this case the previously-mentioned first variation of the device can be used, the body of which has two recesses pointing to opposite sides, one of which takes up the preferably cylindrical base of the figurine with a sliding fit or slight press fit and the other has two sections with different opening cross-sections, of which the lower broadened section can be attached from the top onto the screw cap with a sliding fit or slight press fit, while the upper, narrowed section by means of an inner thread provided on its periphery can be made to mesh with the screw thread of the bottle neck after removal of the screw cap.

Since, however, the bases of figurines intended for the cover of beverage bottles usually are not provided with an opening for a drinking straw, according to another preferred embodiment of the invention, the figurine is attached to the body of the device in such a way that it can be moved with reference to the latter, in order to release and close again an opening communicating with the recess, through which a drinking straw can be introduced into the recess and the neck part of the bottle.

Preferably, the figurine attached to the body can be rotated around an axis with reference to the body, this axis being displaced sideways with reference to a longitudinal axis of the body and of the recess. On the one hand, this permits that the figurine and its base can be swiveled to the side by rotation around the axis in order to free the opening for the drinking straw. On the other hand, such a movement can be realized with an eccentric central pivot projecting beyond the top side of the body, that enters from the bottom into an eccentric complementary opening into the bottom side of the base of the figurine, whereby the central pivot and the opening can serve at the same time as locking means in order to join the base of the figurine separably to the body.

The preferably cylindrical base of the figurine comprises expediently an upper part with a plane platform serving as the surface on which the figurine can stand and a skirt that is at a distance from a circular peripheral edge of the platform and projects from its bottom, as well as a flat cup-shaped bottom part which can be inserted from the bottom into a cylindrical recess of the upper part that is delineated by the lower side of the platform and the skirt, so that the means for attaching the figurine on the platform, such as locking projections that project through openings of the platform and are attached with glue on the bottom side of the platform, are hidden invisibly inside the base part. In this case the opening which is formed at the same time as a locking opening, is placed expediently in the cup-shaped lower part of the base, since there a locking opening that widens towards the top can be formed easily by injection molding.

In order, on the one hand, to improve the visual appearance of the sales unit consisting of device and figurine when the opening for the drinking straw is closed, and on the other hand, to prevent the figurine from being tilted to the side further than is necessary for the opening or closing of the drinking straw opening, the body advantageously has means for limiting the movement of the figurine attached to the body with respect to the body and these cooperate with complementary means on the base of the figurine. These means are expediently a pin projecting parallel to the central pivot beyond the top side of the body which engages into a circular arc-shaped groove that opens to the bottom in the bottom side of the base of the figurine, after this has been attached to the body. These means can serve at the same time for establishing the direction of rotation of the figurine attached to the body for opening or closing the opening.

BRIEF DESCRIPTION OF THE DRAWINGS

The invention will be explained in more detail below with some of the practical examples shown in the drawing. The following are shown.

DETAILED DESCRIPTION OF THE DISCLOSURE

Figure 1:
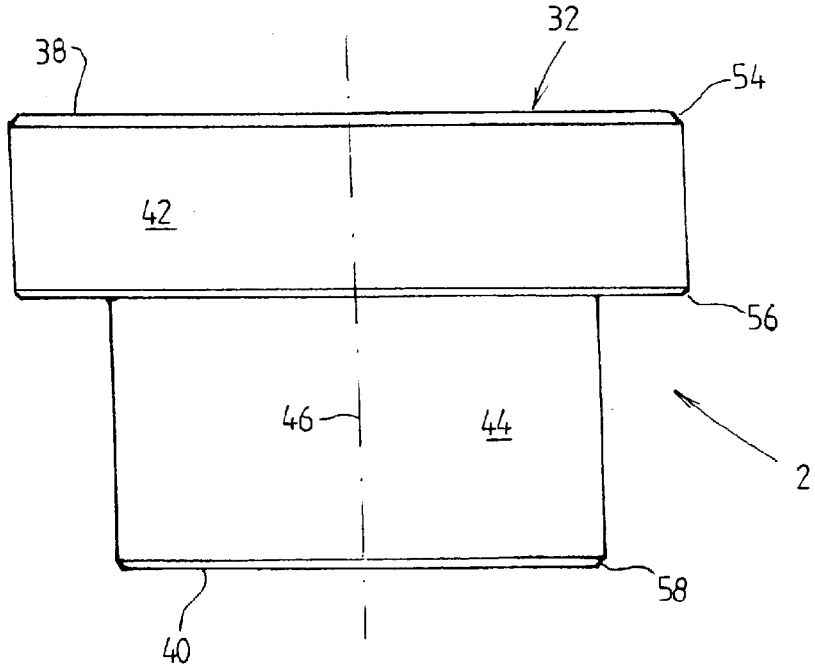
FIG. 1: is a side view of a first embodiment of a device according to the invention for attaching a figurine with a cylindrical base part onto a beverage bottle.

The device 2 shown in the drawings serves for attaching a figurine 4 with a cylindrical base 6 as a merchandising article onto a beverage bottle 8 containing a soft drink.

As shown best in FIGS. 6, 7, 8, 9 and 14, the figurine 4 intended to be attached to the beverage bottle 8 consists of a character known from the movies or television in a three-dimensional, reduced form, made of plastic, in the present case the robot WALL.E® from the film of the same title, which is rigidly attached on the flat base 6. The base 6 has a platform 10 on its top side for the figurine 4 and is provided with a skirt 12 projecting at a radial distance from the circular periphery of the platform 10 from the bottom side thereof, which, together with the platform 10, forms an upper part of the base 6 and has cylindrical outer and inner peripheral surfaces.

Figure 5:
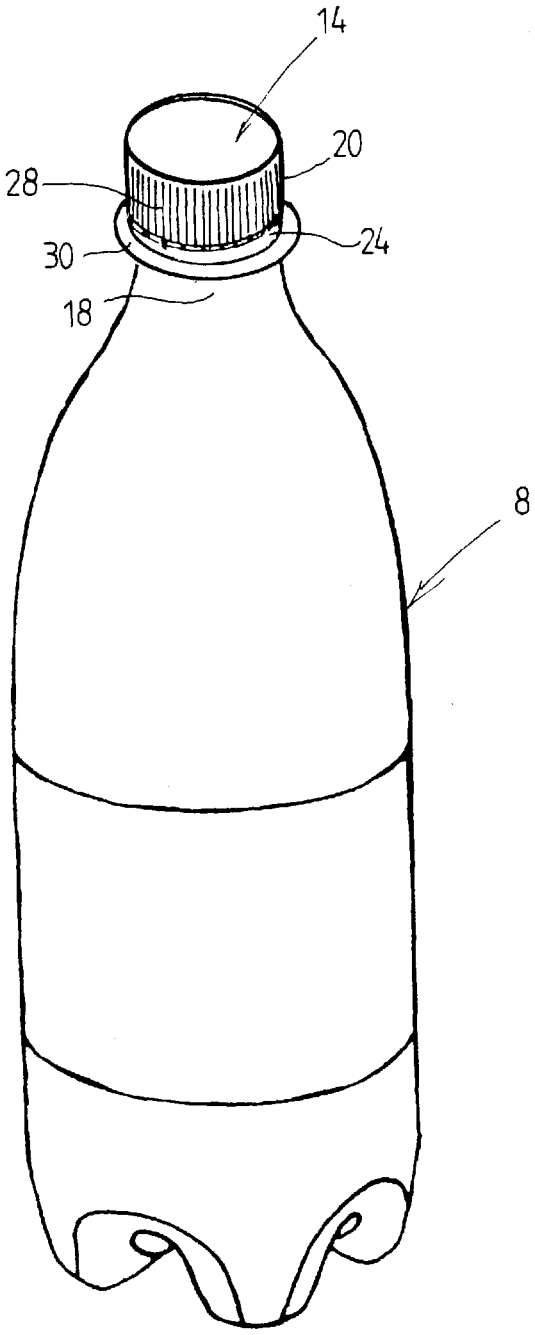
FIG. 5: is a perspective view of a beverage bottle with screw cap before the attachment of the first embodiment of the attaching device and the figurine onto the screw cap.
Figure 6:
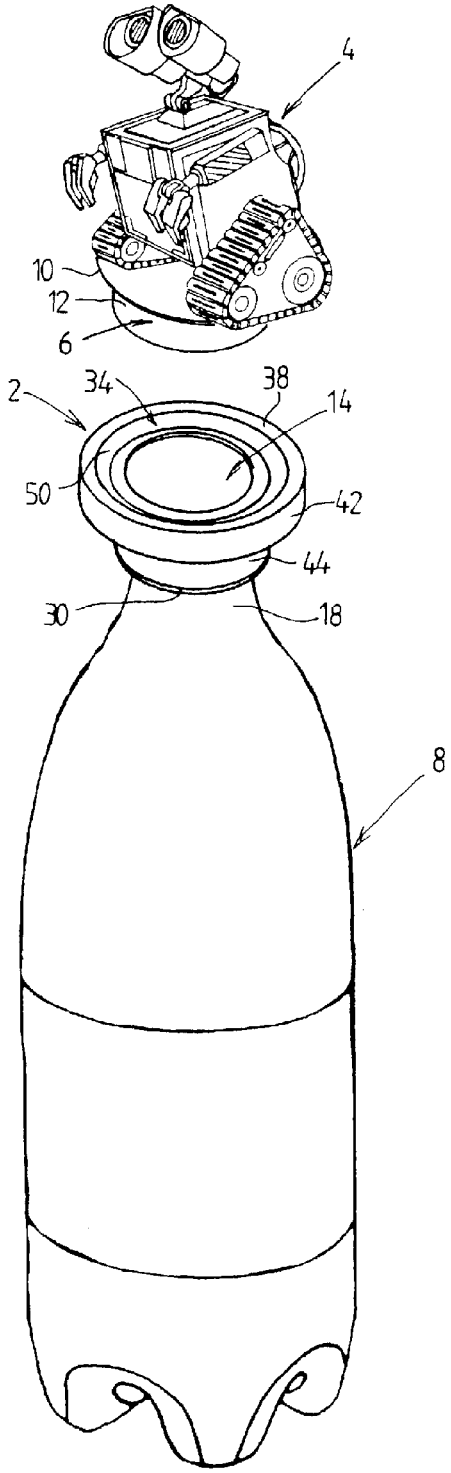
FIG. 6: is a perspective view of the beverage bottle after attachment of the first embodiment of the attaching device shown in FIGS. 1 to 4 and before the attachment of the figurine.
Figure 7:
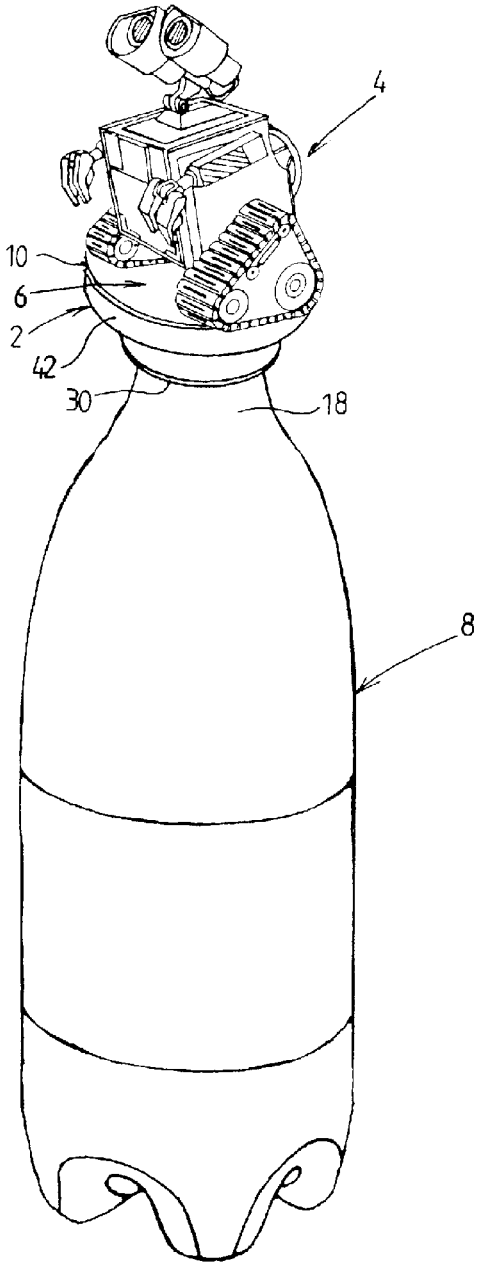
FIG. 7: is a perspective view of the beverage bottle after the attachment of the attaching device and the figurine.

As it is shown best in FIGS. 5 to 7, the figurine 4 can be attached, removably, onto a screw cap 14 of the beverage bottle 8 with the aid of the attaching device 2, and this screw cap serves as a holder for the attaching device 2 and thus for the figurine 4. As shown best in FIGS. 2 and 5, the screw cap 14 which is screwed onto an outer thread 16 at the outer periphery of a neck part 18 of the beverage bottle 8 consists in the known manner of a cup-shaped cover part 20, which, on its inner periphery, is provided with an inner thread 22 that is complementary to the outer thread of the neck part 18, as well as with a safety band 24 that is shrunk onto the neck part 18 of the beverage bottle 8 below the outer thread 16 this band being connected through a number of material bridges 26 to a neighboring lower edge of the cover part 20. When these material bridges 26 are undamaged, they serve as a sign to the client that the beverage bottle 8 has not been opened previously, since when the screw cap 14 is unscrewed for the first time they are torn off. The cover part 20 has a generally cylindrical outer periphery which is provided with a knurling 28.

Below the safety band 24, the neck part 18 of the beverage bottle 8 is provided with a radially projecting collar 30 that facilitates the mechanical manipulation of the beverage bottle 8.

Figure 2:
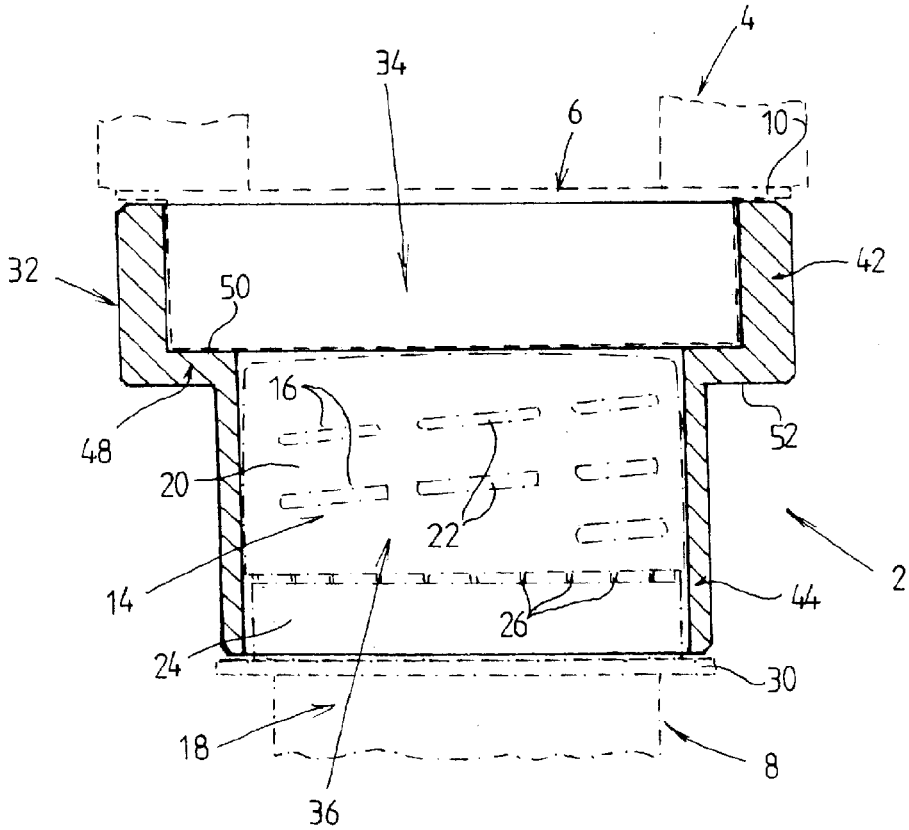
FIG. 2: shows a longitudinal section of the first embodiment of the attaching device.
Figure 3:
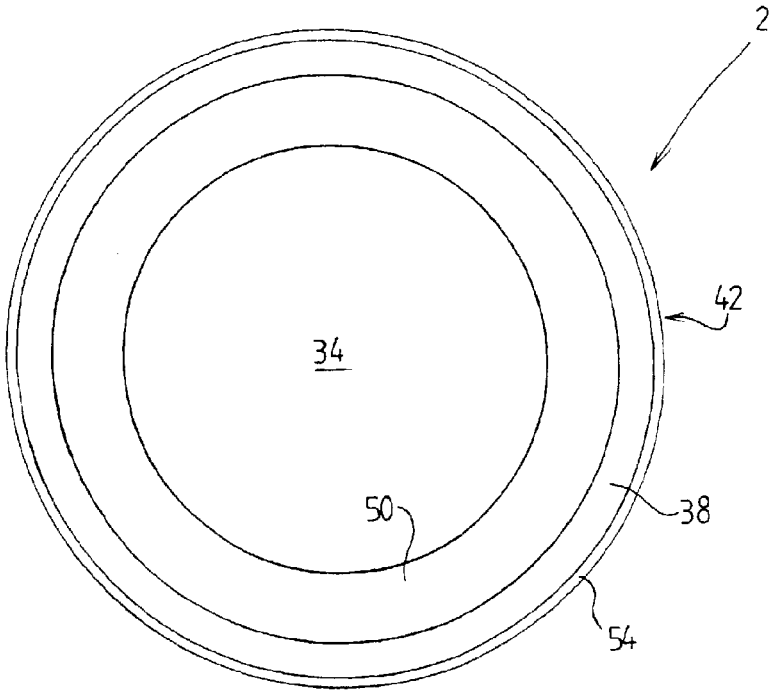
FIG. 3: is a top view of the first embodiment of the attaching device.
Figure 4:
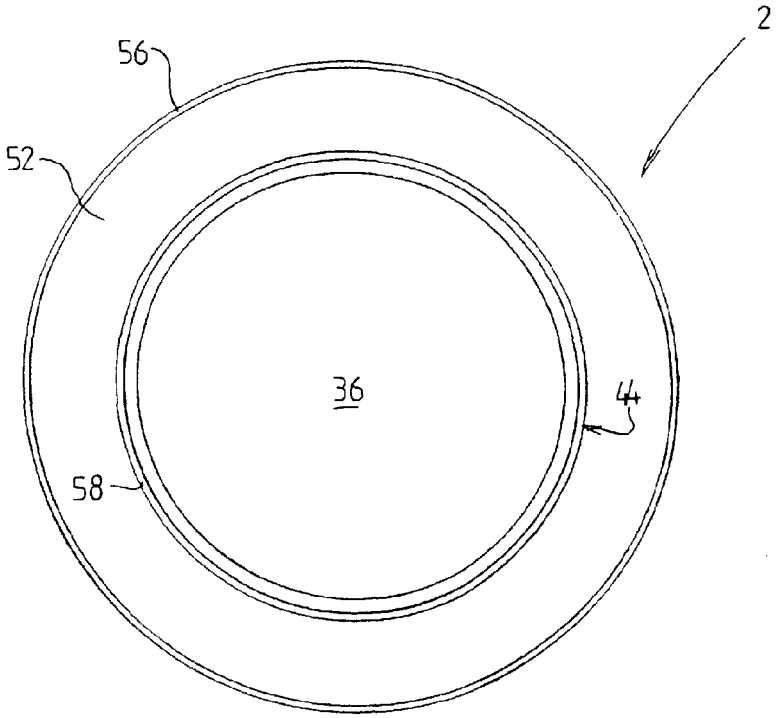
FIG. 4: is a bottom view of the first embodiment of the attaching device.

As can be seen best from FIGS. 1 and 2, the first embodiment of the attaching device 2 shown in FIGS. 1 to 7 consists of an annular body 32 manufactured by injection molding in one piece from a thermoplastic material, which surrounds two coaxial cylindrical recesses 34, 36, one of which serves for holding the cylindrical base part 6 of the figurine 4 shown with dashed lines in FIG. 2 and the other serves for holding the screw cap 14 of the beverage bottle 8, shown with the dashed-dot lines in FIG. 2.

The two recesses 34, 36 are each open to a neighboring upper or lower front end 38, 40 of the body 32 and communicate at their inner ends with one another so that together they form an opening that goes axially through the body 32.

Each of the two recesses 34, 36 is bordered radially toward the outside to an annular peripheral wall 42, 44 (FIG. 2) with an inner and outer cylindrical peripheral surface coaxial to the longitudinal middle axis 46 of the body. The two peripheral walls 42, 44 are joined together by an annular shoulder 48 with two areas 50, 52 that are perpendicular to the longitudinal middle axis 46 of the body 32, of which the inner one, 50, delineates, towards the bottom the upper recess 34 for holding the base part 6 of the figurine 4. This latter recess 34 has an inner diameter which is larger than the inner diameter of the lower recess 36 that serves to hold the screw cap 14 of the beverage bottle 8. The upper peripheral wall 42 is provided at the transition to the plane upper front end 38 of the body 32 as well as at the transition to the lower outer area 52 of the annular shoulder 48 with a chamfer 54, 56, while the lower peripheral wall 44 is provided with a chamfer 58 at the transition to the plane lower front end 40 of the body 32.

The inner diameter and the axial length of the upper recess 34 are adjusted to the outer diameter and to the axial height of the base part 6 of the figurine 4 in such a way that the base part 6 can be introduced with a sliding fit or with a slight press fit from the top into the recess 34, until the lower front end of the base part 6 rests on the surface 50 of the annular shoulder 48 and/or the collar 10 of the base part 6 rests on the upper front end 38. In the case of the attaching device 2 shown in the drawing, the inner diameter of the upper recess 34 is about 40 mm, while the axial height of the recess 36 is about 9 to 10 mm.

The inner diameter of the lower recess 36 is chosen so that it is larger by 5 mm±0.5 mm than the core diameter, and by 3 mm±0.5 mm larger than the pitch diameter of the outside thread 16 formed on the neck part 18 of the beverage bottle 8, which is engaged through the threads with the inner thread 22 of the screw cap 14. In the case of the narrow-neck beverage bottle 8 shown in the drawing, the outer thread has a core diameter and pitch diameter of 24.5 mm and 27 mm, respectively, while the inner diameter of the lower recess is 30 mm.

An attaching device 2, whose lower recess 36 has such an inside diameter, due to the slightly different wall thickness of the cover parts 20 can be attached with a more or less strong press fit separably on all plastic screw caps of typical narrow-neck beverage bottles, for example thin-walled PET disposable or returnable bottles with fruit juices, drinking waters or mineral waters or spritzers or on thick-walled PET returnable bottles with carbonated beverages, the neck part 18 of which always has a standardized outside thread with a core diameter of 24.5 mm and a pitch diameter of 27 mm.

The axial length of the lower recess 36 is chosen so that the upper end of the cap part 20 of the screw cap 14 does not project beyond the area 50 of the annular shoulder 48 into the upper recess 34 when the attaching device 2 is pushed from the top onto the screw cap 14 until contact with the lower front end 40 of the body 32 against the top side of the collar 30, as shown in FIG. 2.

In the case of the attaching device 2 shown in the drawing, the axial length of the recess 36 is about 22 mm.

Figure 8A:
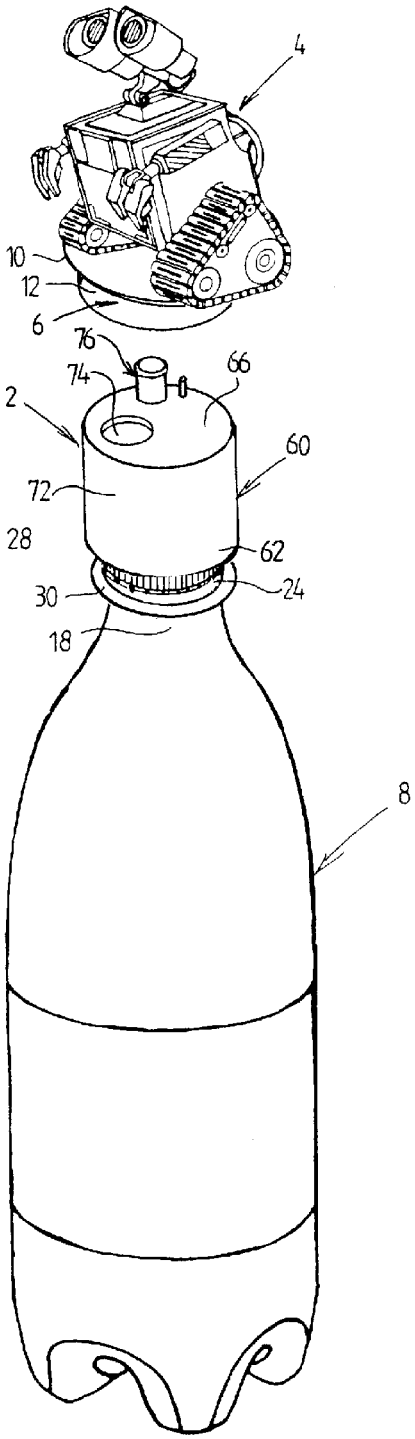
FIGS. 8*a* and 8*b*: are perspective views of the beverage bottle after the attachment of a second embodiment of an attaching device onto the screw cap and after the removal of the screw cap and application onto a thread of a bottle neck, each with the figurine removed.
Figure 11:
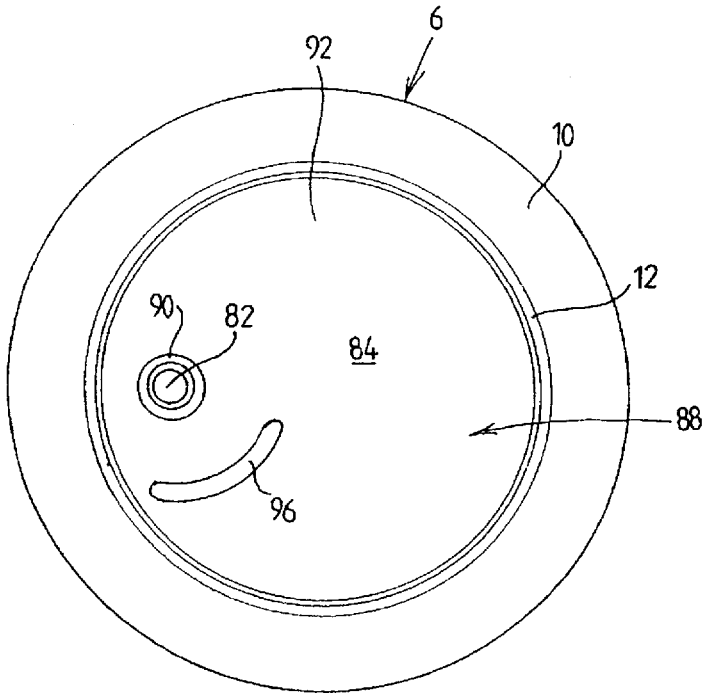
FIG. 11: is a bottom view of a base of the figurine from FIGS. 8 and 9.
Figure 12:
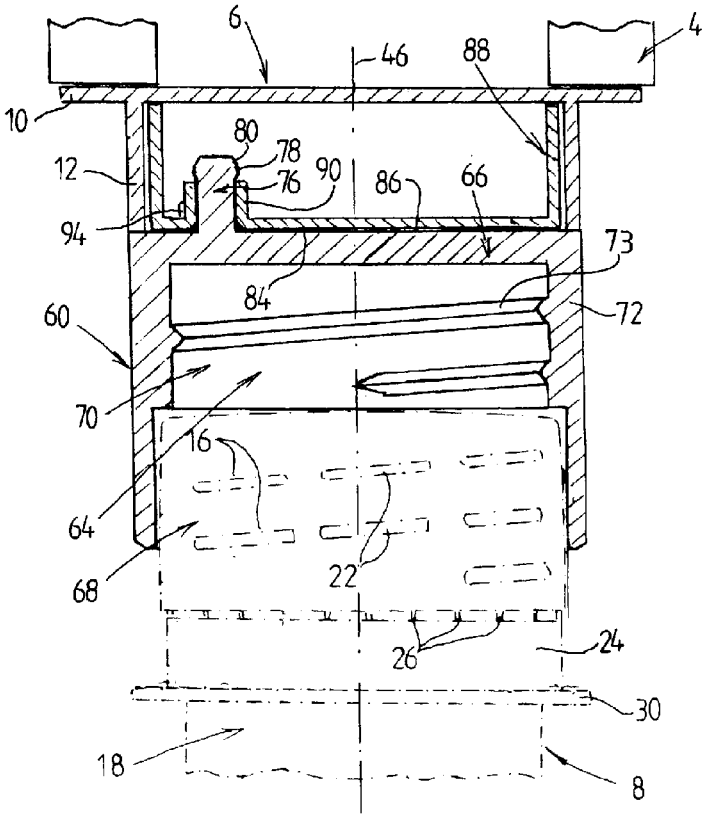
FIG. 12: is a longitudinal section of the attaching device and of the base of the figurine from FIGS. 8 and 9 along line 12-12 of FIG. 10, after attachment onto the screw cap of the beverage bottle according to FIG. 8*a;*

As can be seen best from FIGS. 8*a*, 8*b*, 10 and 11, the second embodiment of the attaching device 2 shown in FIGS. 8 to 13 consists also of a body 60 that is manufactured in one piece from a thermoplastic material by injection molding. As shown in best in FIGS. 12 and 13, the body 60 has a cylindrical outer peripheral surface 62, the outer diameter of which corresponds to the outer diameter of the skirt 12 of the base 6 of the figurine 4. The body 60 has a somewhat larger length than the body 32 of the device 2 in FIGS. 1 to 7 and surrounds a recess 64, which is generally coaxial to the longitudinal middle axis 46 and is open toward the bottom, the recess being delineated at its upper end by a flat end wall 66 of the body 60, this wall being perpendicular to the longitudinal axis 46. The recess 64 is divided into two sections 68, 70 in its longitudinal direction, whose lower section 68, which adjoins the open end of the recess 64, has a larger inner diameter than the upper section 70, which adjoins the end wall 66. The inner diameter of the lower section 68 corresponds to the inner diameter of the recess 36 of the device from FIGS. 1 to 7 and, in the same way as this, is adjusted to the outside diameter of the screw cap 14 of the narrow-neck beverage bottle 8 shown in the drawing, so that this screw cap 14 can be introduced with a more-or-less strong press fit or sliding fit into the lower section 68 of the recess 64, as shown in FIG. 12 and FIG. 8*a* with the figurine 4 removed. This permits that the device 2 can be attached removably on the screw cap 14 before the sale of the beverage bottle 8 as a marketing article in such a way that the figurine 4 sits uprightly on the upper end of the bottle 8.

The cylindrical peripheral wall 72 of the body 60 that surrounds the recess 64 can be provided in the region of the lower section 68 with a longitudinal fluting or similar on its inside, in order to facilitate the introduction of the screw cap 14 into the lower section 68 of the recess and to improve the grip of the device 2 on the screw cap 14. In the region of the upper narrowed section 70, the cylindrical peripheral wall 72 is provided on the inside with an inner thread 73 which fits the outer thread 16 on the neck part 18 of the bottle 8, so that after removing the screw cap 14 and after screwing this off from the outer thread 16 of the neck part 18, the body 60 can be screwed tightly on it, preferably until either the upper front end of the neck part 18 rests against the bottom part of the end wall 66, or until the annular lower front end of the body 60 rests against the top side of the collar 30, as shown in FIG. 13, and a strong screw connection between the device 2 and the bottle 8 is produced.

Figure 8B:
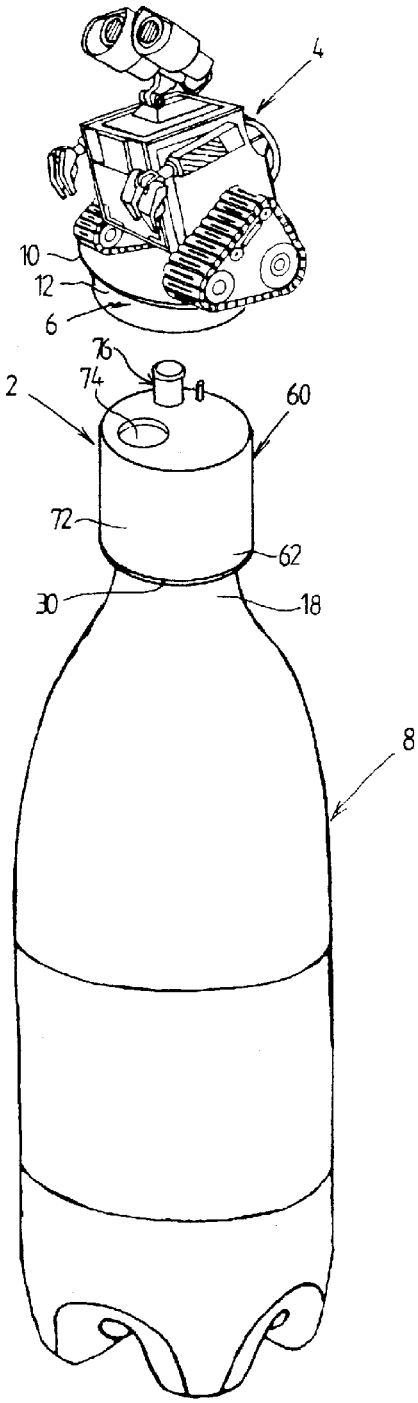
Figure 13:
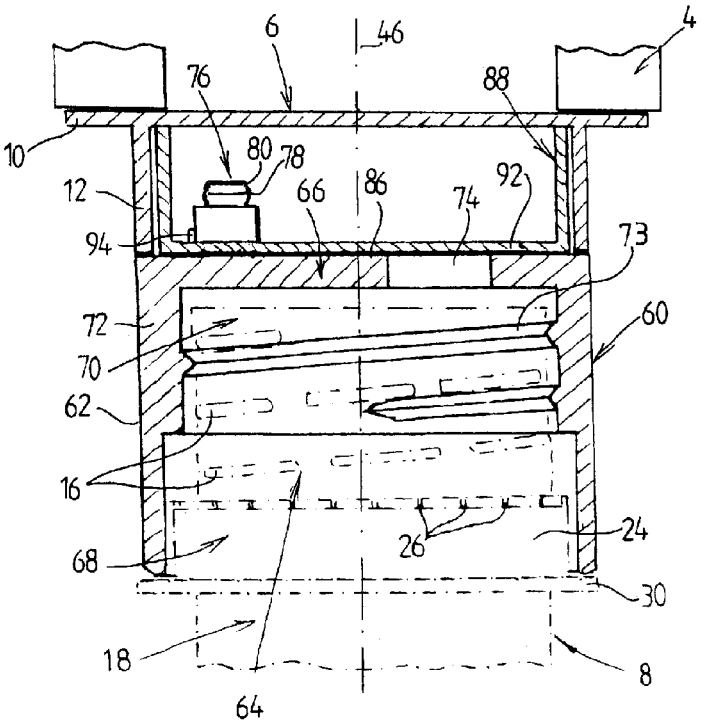
FIG. 13: is a longitudinal section of the attaching device and of the base of the figurine from FIGS. 8 and 9 along line 13-13 of FIG. 10, after attachment onto the screw thread of the bottle neck according to FIG. 8*b;*
Figure 14A:
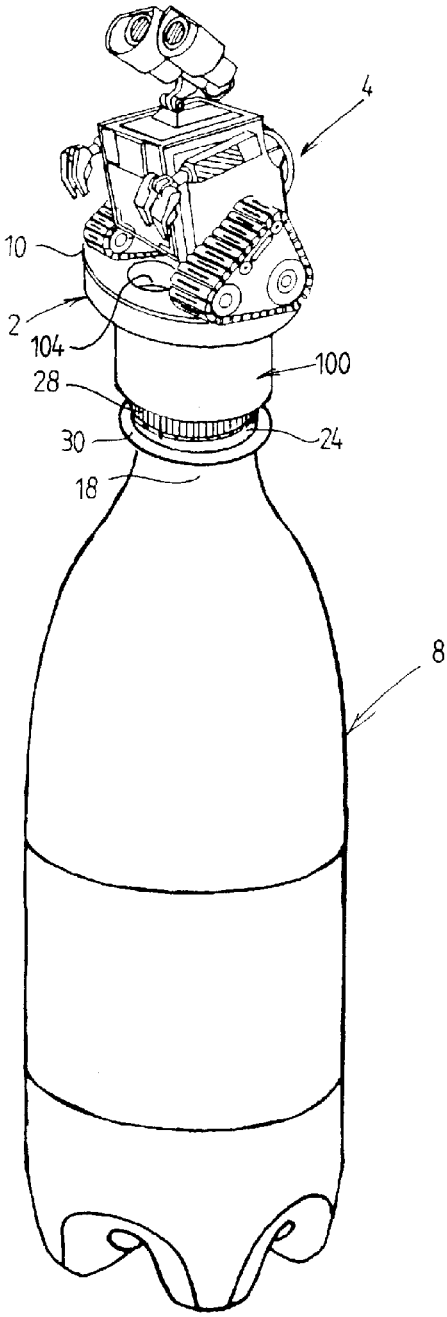
FIGS. 14*a* and 14*b*: are perspective views of the beverage bottle after attachment of a third embodiment of the attaching device onto the screw cap or onto the screw thread of the bottle neck.
Figure 14B:
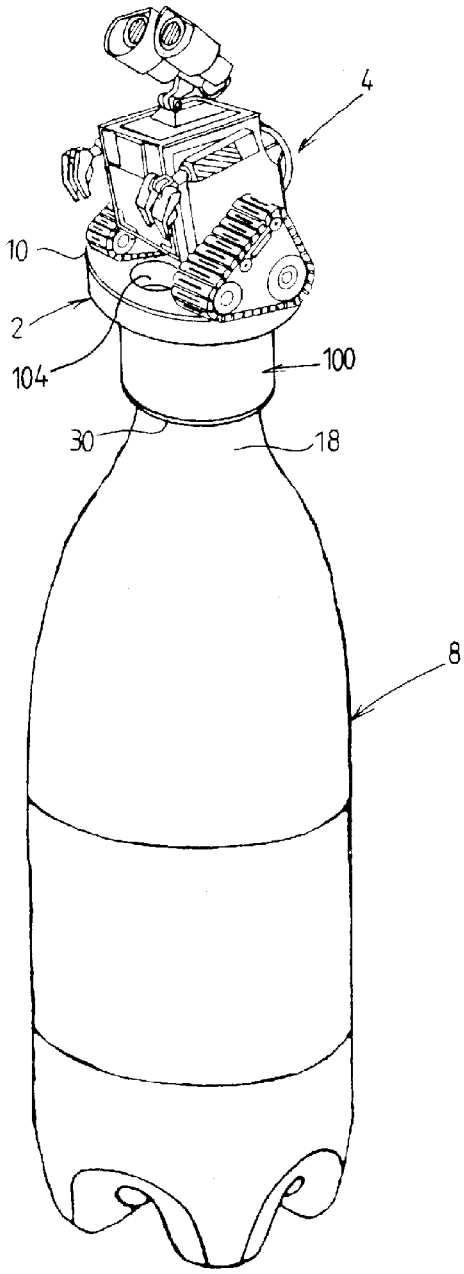

As is shown best in FIGS. 8*a*, 8*b* and 13, the upper end wall 66 of the body has an opening 74 through which a drinking straw (not shown) can be introduced from the top into the recess 64. The opening 74 is arranged in the end wall 66 in such a way that, although it is eccentric with respect to the longitudinal middle axis 46 of the body 60, but after screwing tight the device 2 on the neck part 18 of the bottle 8 still lies above the opening of the neck part 18, so that the drinking straw introduced through the opening 74 into the recess 64 automatically moves further into the inside of the neck part 18 and through this into the inside of the beverage bottle 8.

The separable attachment of the figurine 4 on the device 2 is done here by locking the base 6 of the figurine 4 to the body 60. For this purpose, the body 60 has a locking peg 76 with rotational symmetry that projects in the axial direction toward the top beyond the end wall 66, and the free upper end of this locking peg has a thickened part 78 and above the thickened part 78 it has a conical narrowing as can be seen best in FIGS. 12 and 13.

The locking peg 76 can be introduced from the bottom into a complementary locking opening 82 shown in FIG. 11 in the bottom side of the base 6 of the figurine 4 and locked in the opening 82, whereby a flat bottom side 84 of the base 6 is pressed lightly against the parallel flat top side 86 of the end wall 66. As represented best in FIGS. 12 and 13, the locking opening 82 is formed in a flat cup-shaped lower part 88 of the base 6 which is introduced into a cylindrical recess of the upper part that is open toward the bottom and is delineated by skirt 12 and the platform 10, so that any means that may serve for attaching the figurine 4 on the platform 10, such as locking projections which project through openings of the platform 10 and which are attached with glue on the bottom side of the platform 10 are invisibly hidden inside the base 6.

The locking opening 82 is surrounded by a cylindrical bordering wall 90 which is formed in one piece with a bottom 92 of the lower part 88 by injection molding and is conically widened at its lower end in order to facilitate the introduction of the thickened upper end of the locking peg 76 into the locking opening 82. The height of the cylindrical bordering wall 90 is chosen in such a way that its upper edge after locking is located at the height of an upward widening part of the thickening 78, so that the base 6 is pressed lightly with the bottom side of the bottom 92 against the top side 86 of the end wall 66 of the body 60, in order to seal the opening 72 in the closed state.

As a result of the rotationally symmetrical form of the locking peg 76 and the locking opening 82, the figurine 4 together with base 6 after locking with the body 60 of the device 2 can be rotated with respect to the latter around the longitudinal axis of the locking peg 76 and the locking opening 82.

Figure 9A:
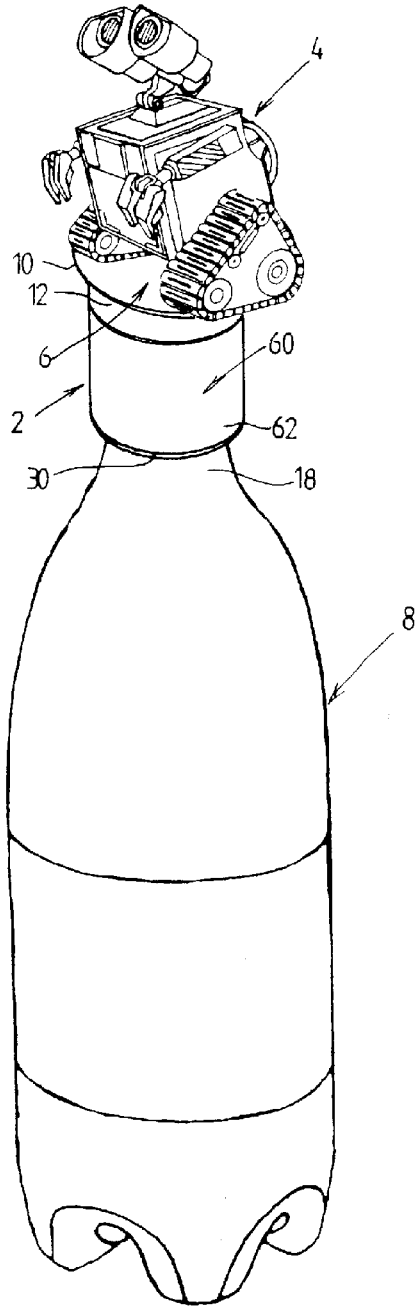
FIGS. 9*a* and 9*b*: are perspective views of the beverage bottle after the attachment of the attaching device onto the screw thread of the bottle neck, which at the same time show different rotational positions of the figurine attached onto the attaching device.

The locking peg 76 is arranged eccentrically with respect to the longitudinal middle axis 46 of the body 60 similarly to the locking opening 82 with respect to a longitudinal middle axis of the base 6. The eccentricity and the position of the locking peg 76 with respect to the opening 74 are chosen in such a way that the opening 74 is closed tightly by the bottom 92 of the base 6 of the figurine 4 when the peripheral area 62 and the longitudinal middle axis 46 of the body 60 are flush with the peripheral area of the skirt 12 and respectively with the longitudinal middle axis of the base 6, as shown in FIG. 9*a*. However, when the base 6 of the figurine 4 is rotated from the position shown in FIG. 9*a* around the longitudinal axis of the locking peg 76 with respect to the body 60, the opening 74 is released by this rotational movement as shown in FIG. 9*b*.

Figure 9B:
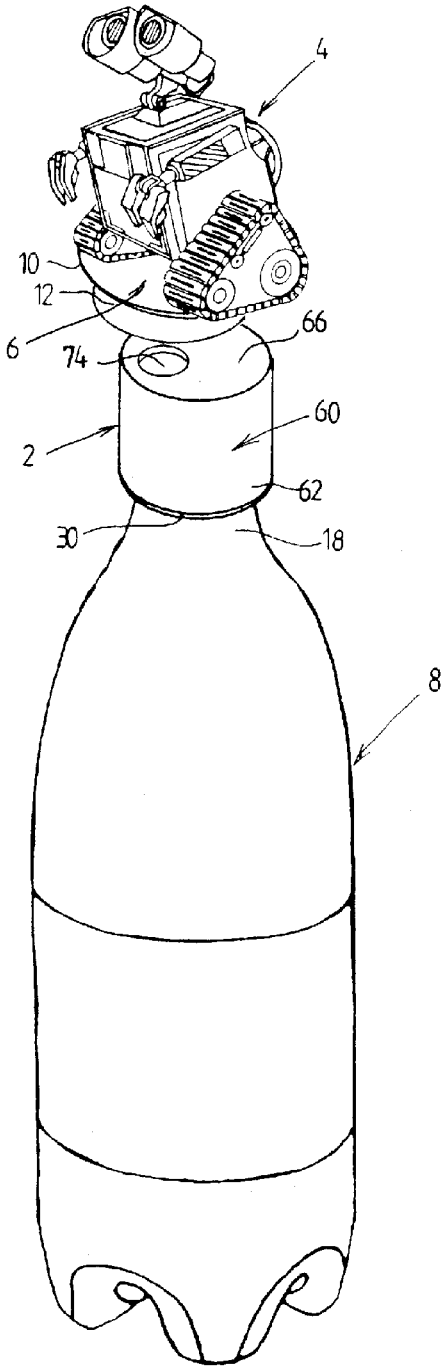
Figure 10:
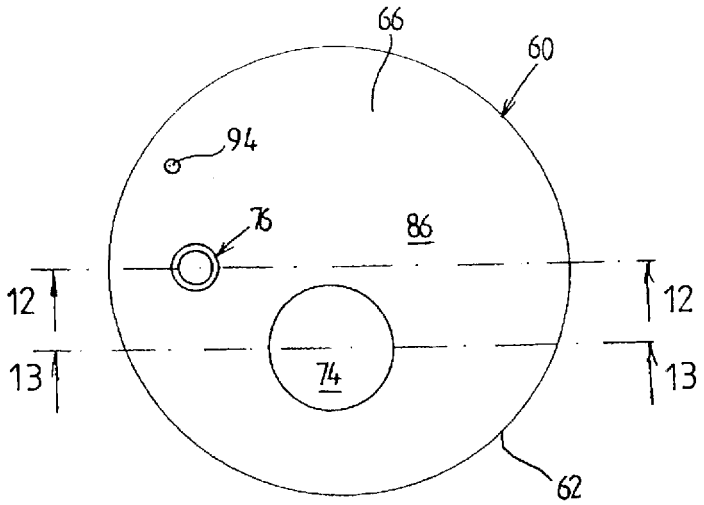
FIG. 10: is a top view of the attaching device from FIGS. 8 and 9.

In order to limit the rotational movement, a pin 94 which is parallel to the locking peg 76 projects upwardly beyond the end wall 66, which, after locking of the base 6 of the figurine 4 to the body 60, projects into an arc-shaped recess 96 which is open toward the bottom (FIG. 11) in the bottom 92 of the lower part 88, and in both end positions shown in FIGS. 9*a* and 9*b*, abuts against one of the two front ends of the recess 96. The recess 96 is preferably arranged in such a way that the base 6 of the figurine 4 when screwed on to the neck part 18 of the bottle 8 can be swiveled out from the position shown in FIG. 9*a* against the direction of rotation of the body 60.

The third embodiment of the attaching device 2 represented in FIGS. 8 to 13 also consists of a body 100 manufactured from a thermoplastic material by injection molding, which, like the body 32 of the device 2 in FIGS. 1 to 7 has a recess 34 that is open toward the top, into which the base 6 of the figurine 4 can be inserted from above with a slight press fit. The body 100 also has a recess 64 that is open toward the bottom with two sections 68 and 70, the form and measurements of which correspond to the form and the measurements of the sections 68 and 70 of the recess 64 of the device 2 in FIGS. 8 to 13, so that the body 100 can likewise be attached both to the screw cap 14 and onto the outside thread 16 of the neck part 18 of the bottle 8.

Figure 15:
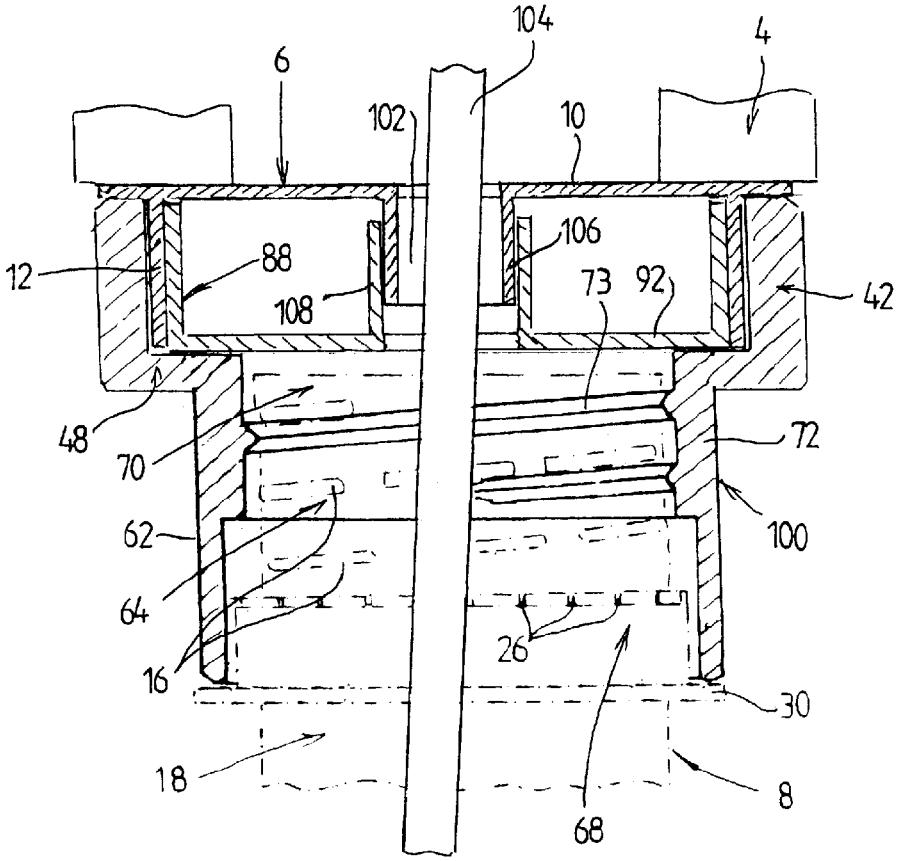
FIG. 15: is a longitudinal sectional view of the attaching device from FIGS. 14*a* and 14*b* after attachment onto the screw thread of the bottle neck.

In contrast to the previously-described devices 2, here the base 6 of the figurine 4 is provided with an opening 102 going through the platform 10 and the bottom 92 of the bottom part 88, which is surrounded by cylindrical sleeves 106, 108 that engage with one another and are formed on the platform 10 and on the bottom 92, respectively. Through this opening 102, a drinking straw 104 can be introduced into both recesses 34 and 64 as well as through the recesses 34 and 64 into the inside of the neck part 18 of the bottle 8, as shown best in FIG. 15, after the body 100 has been screwed onto the outside thread 16 of the neck part 18, as was described for the second embodiment. In the FIGS. 14*a*, 14*b* and 15, the same reference numbers correspond to the same parts as in the other figures and therefore do not have to be explained again.

The invention claimed is:

1. A device for a beverage bottle having a neck part with an outside thread and a screw cap, wherein the device comprises:

a figurine; and a body having means for separable attachment of the figurine to the body and having a recess located below the means for separable attachment in the body configured for attaching the body to the screw cap and to the outside thread of the neck part of the beverage bottle after removal of the screw cap, wherein the recess has an open lower end, a lower section adjoining the open end, and having a first inner cross section, and an upper section having a second inner cross section, the first inner cross section being larger than the second inner cross section wherein the lower section holds the screw cap with a sliding fit or a slight press fit, wherein an inside peripheral wall of the upper section is provided with an inside thread for engagement with the outside thread of the neck part of the beverage bottle after removal of the screw cap, wherein an upper end wall of the body has a through opening through which a drinking straw can be introduced from above into the recess, and wherein the figurine attached to the body can be moved with respect to the body in order to open or close the through opening in the body, through which the drinking straw can be introduced into the recess.

2. The device according to claim 1, wherein the figurine can be rotated with respect to the body around an axis which is offset with respect to a longitudinal axis of the body and of the recess.

3. The device according to claim 1, wherein the means for separable attachment of the figurine comprise locking means on the body which can be brought into a locking engagement with complementary locking means on the figurine or on a base of the figurine.

4. The device according to claim 3, wherein the complementary locking means is on the base and wherein the locking means comprises a locking peg, which extends above an upper end wall of the body and which can be introduced into a locking opening in the base of the figurine.

5. The device according to claim 1, further comprising means for limiting the movement of the figurine attached to the body with respect to the body between two end positions.

6. The device according to claim 5, wherein in one of the end positions in which the through opening is closed, a peripheral surface of the body and a neighboring peripheral surface of a base of the figurine are flush.

7. A combination of a figurine and a device for attachment of the figurine on a beverage bottle having a neck part with an outside thread and a screw cap, wherein the device comprises a body having means for separable attachment of the figurine to the body, wherein the means for separable attachment comprises a recess, into which a base of the figurine can be inserted from above, and having a further recess below the means for separable attachment in the body for holding the screw cap and for engagement with the outside thread of the neck part of the beverage bottle after removal of the screw cap, wherein the recess and the further recess communicate with each other, and wherein the base of the figurine has a through opening for a drinking straw wherein, after separable attachment of the figurine on the body of the device, the through opening communicates with the recess and the further recess that pass through the body, and wherein the further recess has an open lower end, a lower section adjoining the open end and having a first inner cross section for holding the screw cap with a sliding fit or a slight press fit, and an upper section having a second inner cross section smaller than the first inner cross section, wherein an inside peripheral wall of the upper section is provided with an inside thread for engagement with the outside thread of the neck part of the beverage bottle after removal of the screw cap.

8. A beverage bottle having a neck part with an outside thread and a screw cap and being provided with a figurine, the figurine being separably attached to the screw cap by means of an attachment device, wherein the attachment device comprises a body having means for separable attachment of the figurine to the body and having a recess below the means for separable attachment of the figurine in the body, wherein the recess has an open lower end, a lower section adjoining the open end and having a first inner cross section, and an upper section having a second inner cross-section, the first inner cross section being larger than the second inner cross section, wherein the lower section holds the screw cap with a sliding fit or a slight press fit, wherein an inside peripheral wall of the upper section is provided with an inside thread for engagement with the outside thread of the neck part of the beverage bottle after removal of the screw cap, and wherein an upper end wall of the body has a through opening, through which a drinking straw can be introduced from above into the recess.

9. The device according to claim 3, further comprising means for limiting the movement of the figurine attached to the body with respect to the body between two end positions.

10. The device according to claim 9, wherein in one of the end positions in which the opening is closed, a peripheral area of the body and a neighboring peripheral area of a base of the figurine are flush.

11. A beverage bottle having a neck part with an outside thread and a screw cap and being provided with a figurine, the figurine being separably attached to the screw cap by means of an attachment device, wherein the attachment device comprises a body having a recess in the body, into which a base of the figurine can be inserted from above, and having a further recess in the body, the recess and the further recess communicating with each other, wherein the further recess has an open lower end, a lower section adjoining the open end and having a first inner cross section, and an upper section having a second inner cross-section, the first inner cross section being larger than the second inner cross section, wherein the lower section holds the screw cap with a sliding fit or a slight press fit, wherein an inside peripheral wall of the upper section is provided with an inside thread for engagement with the outside thread of the neck part of the beverage bottle after removal of the screw cap, and wherein the base of the figurine has a through opening for a drinking straw wherein, after separable attachment of the figurine on the body of the device, the through opening communicates with the recess and the further recess that pass through the body.

* * * * *